US009595762B2

(12) United States Patent
Huang et al.

(10) Patent No.: US 9,595,762 B2
(45) Date of Patent: Mar. 14, 2017

(54) PRINTED ANTENNA MODULE APPLIED TO THE RF DETECTION PROCEDURE

(71) Applicant: Arcadyan Technology Corporation, Hsinchu (TW)

(72) Inventors: Chih-Yung Huang, Taichung (TW); Jian-Jhih Du, Taipei (TW); Kuo-Chang Lo, Miaoli County (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 463 days.

(21) Appl. No.: 13/963,356

(22) Filed: Aug. 9, 2013

(65) Prior Publication Data

US 2014/0168029 A1 Jun. 19, 2014

(30) Foreign Application Priority Data

Dec. 14, 2012 (TW) ..... 101147350 A

(51) Int. Cl.
*H01Q 1/38* (2006.01)
*H01Q 9/06* (2006.01)
(Continued)

(52) U.S. Cl.
CPC ..... *H01Q 9/06* (2013.01); *H01Q 1/243* (2013.01); *H01Q 1/36* (2013.01); *H01Q 5/371* (2015.01); *H01Q 9/0421* (2013.01); *H01Q 9/42* (2013.01)

(58) Field of Classification Search
CPC ..... H01Q 9/42
See application file for complete search history.

(56) References Cited

U.S. PATENT DOCUMENTS

2006/0017621 A1 1/2006 Okawara et al.
2006/0220871 A1 10/2006 Baba et al.
(Continued)

FOREIGN PATENT DOCUMENTS

CN 1338794 A 3/2002
CN 102315513 A 1/2012
TW 200842366 A 11/2008

OTHER PUBLICATIONS

Jin-Hua Chen et al., "Compact PIFA using capacitive coupled-fed for LTE/GSM/UMTS WWAN operation in the mobile application", cross strait quad-regional radio science and wireless technology conference (CSQRWC), 2011, IEEE, Jul. 26, 2011, pp. 414-417, XP032459419.
(Continued)

*Primary Examiner* — Graham Smith
(74) *Attorney, Agent, or Firm* — Rabin & Berdo, P.C.

(57) ABSTRACT

A printed antenna module applied to an RF detection procedure is provided. The module comprises a substrate, a ground terminal part, a feeding part, an antenna body, and a second connecting end. The substrate comprises a first surface and a second surface. The ground terminal part and the feeding part are disposed on the first surface. A first end of the feeding part corresponds to the ground terminal part. The antenna body, disposed on the first surface relative to the ground terminal part, comprises a first extending part. One end of the first extending part forms a first connecting end. The second connecting end is disposed on the first surface. The shapes of the first and the second connecting ends correspond to each other. A second end of the feeding part is connected to the second connecting end. An RF detection point is formed on the second surface.

9 Claims, 4 Drawing Sheets

(51) Int. Cl.

| | |
|---|---|
| ***H01Q 1/24*** | (2006.01) |
| ***H01Q 9/04*** | (2006.01) |
| ***H01Q 9/42*** | (2006.01) |
| ***H01Q 1/36*** | (2006.01) |
| ***H01Q 5/371*** | (2015.01) |

(56) References Cited

U.S. PATENT DOCUMENTS

| | | | |
|---|---|---|---|
| 2008/0094284 | A1 | 4/2008 | Mei |
| 2008/0198088 | A1 | 8/2008 | Lin et al. |
| 2011/0149544 | A1 | 6/2011 | Khan |

OTHER PUBLICATIONS

Taiwanese Office Action dated Mar. 11, 2015.
Chinese Office Action dated Jul. 3, 2015.

PRINTED ANTENNA MODULE APPLIED TO THE RF DETECTION PROCEDURE

This application claims the benefit of Taiwan application Serial No. 101147350, filed Dec. 14, 2012, the subject matter of which is incorporated herein by reference.

BACKGROUND OF THE INVENTION

Field of the Invention

The invention relates in general to a printed antenna module applied to the RF detection procedure, and more particularly to a printed antenna module whose antenna structure maintains corresponding design in response to the operation of the RF detection procedure and capable of effectively downsizing the printed antenna module of the module or device.

Description of the Related Art

Along with the development in the mobile technology, small-sized or portable electronic devices such as notebook computer, PDA, mobile phone or tablet PC are continually developed and invented. These electronic products have played an important role in our daily lives and brought about considerable convenience and practical use. These electronic devices have another important application that is, the transmission of wireless signals, and can perform functions such as telephone communication and Internet connection. The function of wireless signal transmission refers to the reception and transmission of wireless signals by using an antenna of the device by way of radio frequency (RF). The antenna can be external to or in-built in the device.

In response to the features of lightweight, slimness and compactness as required of portable electronic devices, wireless signal transmission modules are designed and manufactured according to the above features. Of the currently available technologies, the small antenna mainly has two types, namely, the chip antenna and the planar antenna. The planar antenna further comprises the micro-strip antenna and the printed antenna. Of the planar antenna, the planar inverse-F antenna (herein after, PIFA) or the mono-pole antenna, advantageously having light structure and excellent transmission efficiency and being easy to manufacture and capable of easily disposed on the inner wall of the device, has been widely used in various portable electronic devices.

The RF detection procedure is applied to the antenna or wireless signal transmission module manufactured according to the currently available technologies to assure product quality in the reception/transmission of wireless signals. Referring to FIG. 1 and FIG. 2. FIG. 1 is a structural diagram of a conventional mono-pole antenna 100 applied to RF detection. FIG. 2 is a structural diagram of a conventional planar inverse-F antenna (PIFA) 200 applied to RF detection. As indicated in FIG. 1, the mono-pole antenna 100 mainly comprises a circuit board 10, an antenna body 11 disposed on one surface of the circuit board, and a ground terminal part 12 corresponding to the antenna body 11. The shape of the antenna body 11 is designed according to the needs in transmission. For instance, the shapes of extending parts 13, 14, 15, and 16 are designed according to the needs in transmission. The mono-pole antenna 100 further comprises a feeding part 17, and a circuit breaker 18 connected to one end of the extending part 13.

According to the conventional design, the circuit breaker 18 is mainly composed of two adjacent connecting ends 181 and 182 which are not conducted. As indicated in FIG. 1, the connecting ends 181 and 182 form an L-shape, and are corresponding to each other. One connecting end 181 is connected to the extending part 13 via an extension cord 180, and the other connecting end 182 is directly connected to the feeding part 17.

The RF detection procedure can be completed by using a probe (not illustrated in diagram) to contact a detection point disposed on another surface of the circuit board 10. The detection point is corresponding to the connecting end 182 via relevant through holes on the circuit board 10 to form electrical connection (the detection point can be partly distributed to another surface of the circuit board 10 corresponding to the feeding part 17). That is, signal reception is detected under the circumstances that the connecting end 182 is separated from relevant extending parts of the antenna body 11. Then, after the detection is completed, the connecting ends 181 and 182 are electrically connected by a solder tin, such that signals can be normally transmitted and the product manufacturing is thus completed.

The circuit breaker disclosed above is a necessary manufacturing for detecting product quality. Since the portable electronic device and its corresponding circuit board 10 are expected to have the features of lightweight, slimness and compactness, the area A1 at which the circuit breaker 18 is disposed will occupy the design space which would otherwise be occupies by other system components on the same board. Or, in order to accommodate these system components, the overall size of the circuit board 10 or the area of the ground terminal part 12 will be relatively increased. For the circuit board products which have large production scale but very low profit margin, the manufacturing cost will be inevitably increased.

The structure of the planar inverse-F antenna (PIFA) 200 has similar problems. As indicated in FIG. 2, the components common or similar to the mono-pole antenna 100 retain the same or similar numeric designations. The PIFA 200 comprises a circuit board 20, an antenna body 21, a ground terminal part 22, relevant extending parts 23 and 24, a feeding part 27, a circuit breaker 28. The planar inverse-F antenna (PIFA) and the mono-pole antenna are different mainly in that the antenna body 21 is connected to a ground point, while the mono-pole antenna has one terminal point used for feeding signals and separated from the ground point. Similarly, under the design that the connecting end 281 of circuit breaker 28 is connected to the extending part 23 via an extension cord 280, and the connecting end 282 is directly connected to the feeding part 27, the area A2 at which the circuit breaker 28 is disposed will increase the overall size of the circuit board 20.

Thus, how to resolve the above mentioned problems which have existed in the industries so as to increase production efficiency is a main purpose of the present invention.

SUMMARY OF THE INVENTION

The invention is directed to a printed antenna module applied to the RF detection procedure. The antenna module is used in an electronic device capable of performing wireless signal transmission, and particular to a small-sized or portable electronic device. The antenna structure of the printed antenna module of the present invention has corresponding design operating in response to the operation of the RF detection procedure. In comparison to the convention structure, the invention effectively downsizes the module or device.

According to one embodiment of the present invention, a printed antenna module applied to an RF detection procedure is provided. The module comprises a substrate, a ground terminal part, a feeding part, an antenna body, and a second connecting end. The substrate comprises a first surface and a second surface. Both the ground terminal part and the feeding part are disposed on the first surface. A first end of the feeding part is corresponding to the ground terminal part. The antenna body is disposed on the first surface relative to the ground terminal part, and comprises a first extending part, and one end of the first extending part forms a first connecting end. The second connecting end is disposed on the first surface adjacent to the first connecting end. The shapes of the first connecting end and the second connecting end are corresponding to each other. A second end of the feeding part is connected to the second connecting end, and an RF detection point is formed on the second surface corresponding to the second connecting end.

Based on the concepts of the present invention, the first extending part is for adjusting impedance matching, the antenna body further comprises a second extending part for radiating transmission signals, and the other end of the first extending part is connected to the second extending part.

Based on the concepts of the present invention, the shapes of the first connecting end and the second connecting end, such as L-shapes, semi-circles, triangles or rectangles, are corresponding to each other, and circuit breakage occurs between the first connecting end and the second connecting end.

Based on the concepts of the present invention, the printed antenna module of the present invention comprises a solder bump. The solder bump is soldered on the first connecting end and the second connecting end after the RF detection procedure is completed, such that a path is formed between the first connecting end and the second connecting end.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 3:
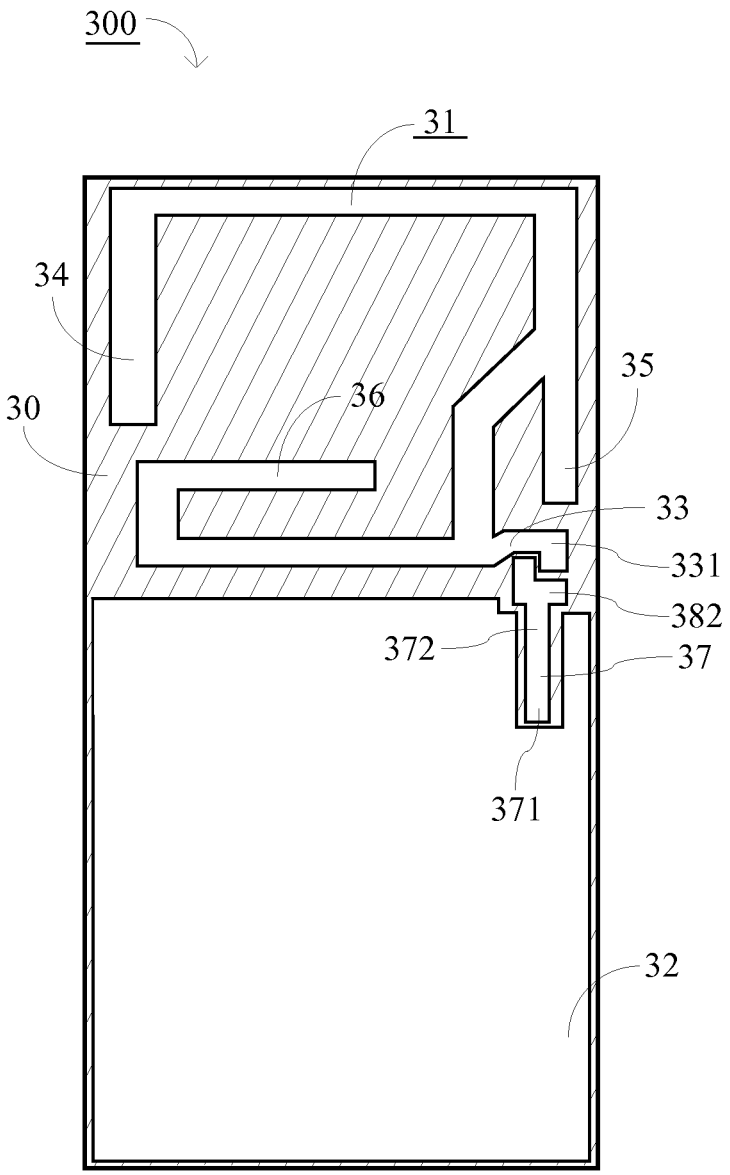
FIG. 3 is a schematic diagram of a printed antenna module 300 applied to an RF detection procedure according to an embodiment of the present invention.

The implementation of the present invention is exemplified by a first embodiment disclosed below. Referring to FIG. 3, a schematic diagram of a printed antenna module 300 applied to an RF detection procedure according to an embodiment of the present invention is shown. As indicated in FIG. 3, the printed antenna module 300 mainly comprises a substrate 30, a ground terminal part 32 and an antenna body 31. The substrate 30 relates to a printed circuit board formed by a dielectric material. The printed circuit board has two surfaces but only a first surface is illustrated in FIG. 3. The antenna body 31 of FIG. 3 is exemplified by a mono-pole antenna. The ground terminal part 32 is disposed on the first surface of the substrate 30, and the antenna body 31 is disposed and printed on the first surface corresponding to the ground terminal part 32.

The ground terminal part 32 formed on the first surface relates to a printed metal surface, and no relevant circuit structures are formed on the other surface of the substrate 30, such that the printed antenna module 300 forms a dual-layer board. The other surface relates to a second surface not illustrated in FIG. 3; the second surface and the first surface are two opposite surfaces of the substrate 30. In other implementations, another ground metal surface can be formed on the other surface of the substrate 30, such that the entire module forms a tri-layer board. It should be noted that under the structure of tri-layer board (or more layers), the area on another surface corresponding to the position of the antenna body 31 must be hollowed for the antenna to radiate signals. That is, no metal structures can be disposed on the corresponding area within the projection of the antenna body 31.

Figure 1:
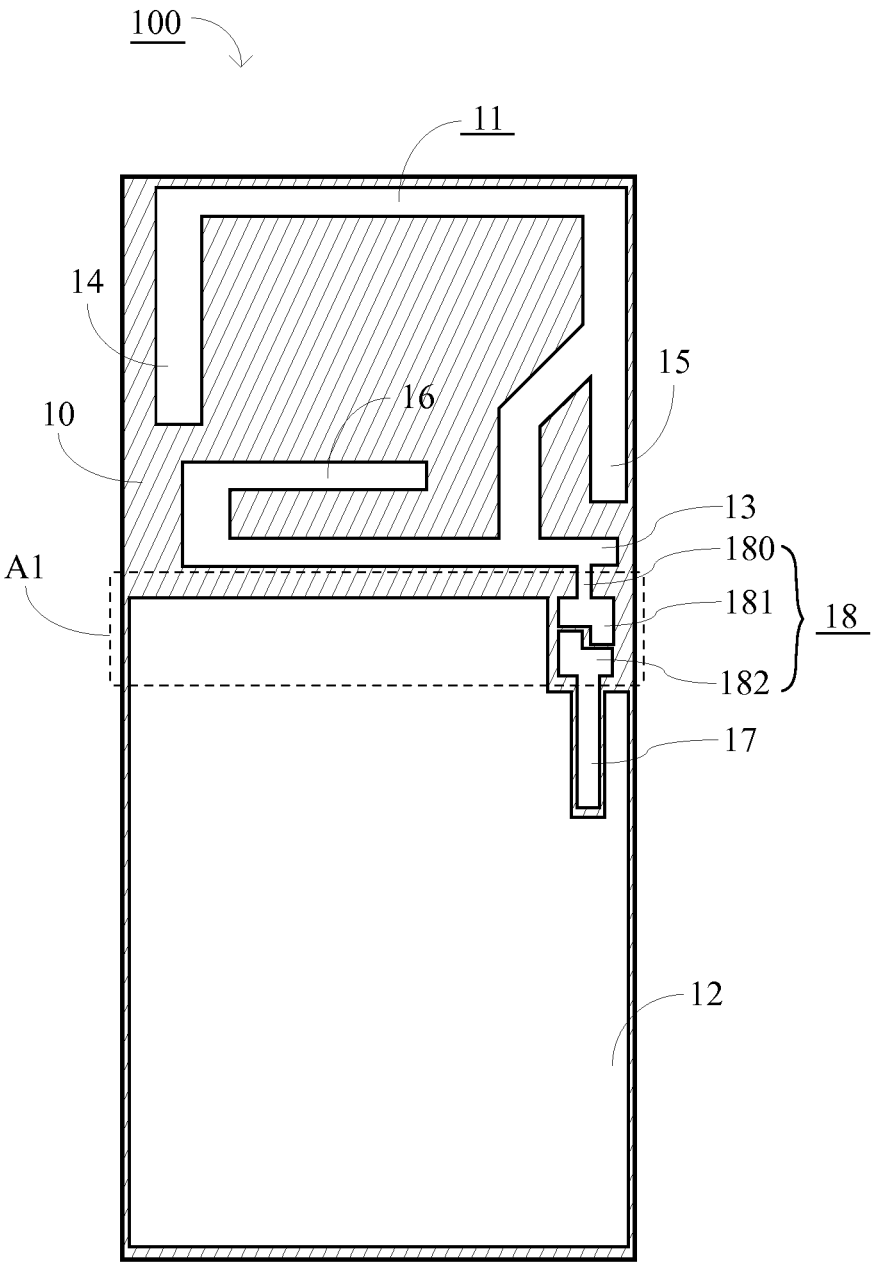
FIG. 1 (prior art)
FIG. 1 (prior art) is a structural diagram of a conventional mono-pole antenna 100 applied to RF detection.

As indicated in FIG. 3, the structure of the printed antenna module 300 of the present invention is partly similar to that of the mono-pole antenna 100 of FIG. 1 (prior art). That is, the antenna body 31 further comprises a first extending part 33, a second extending part 34, a third extending part 35 and a fourth extending part 36. The components common or similar to the mono-pole antenna 100 retain the same or similar numeric designations. The second extending part 34 and the fourth extending part 36 are radiation segments used for transmitting signals. That is, the extended lengths of the extending parts have much to do with the frequencies of response and resonance. In addition, the third extending part 35 and the first extending part 33 are segments used for adjusting impedance matching. That is, the shapes of the extensions of the third extending part 35 and the first extending part 33 can make the voltage standing wave ratio of antenna (herein after, VSWR) meet the required conditions.

The present invention is further featured in that one end of the first extending part 33 forms a first connecting end 331, and the other end of the first extending part 33 is connected to the second extending part 34. The printed antenna module 300 further comprises a feeding part 37 and a second connecting end 382. As indicated in FIG. 3, the feeding part 37 is disposed on the first surface of the substrate 30 and used for feeding signals, and a first end 371 is corresponding to the ground terminal part 32 and can be directly connected to an RF circuit or via a feeder line. The RF circuit can be disposed on the ground terminal part 32 but is not illustrated in the diagram. The second connecting end 382 is adjacent to the first connecting end 331 and disposed on the first surface of the substrate 30, and is further connected to a second end 372 of the feeding part 37. In greater details, the feeding part 37 can be directly formed on the substrate 30 by a 50 Ohm (Ω) circuit. The first end 371 of the feeding part 37 can be extended in response to the position of a ground point of the ground terminal part 32, and the second end 372 forms a feeding point.

Similarly, the shapes of the second connecting end 382 and the first connecting end 331 are corresponding to each other. As indicated in FIG. 3, the connecting ends 331 and 382 are L-shaped and corresponding to each other. Meanwhile, circuit breakage occurs between the first connecting end 331 and the second connecting end 382 such that the RF detection procedure can be performed. On the other hand, an RF detection point (not illustrated in diagram) is formed on the second surface of the substrate 30 corresponding to the second connecting end 382. In greater details, the substrate 30 has a through hole via which the RF detection point is electrically connected to the second connecting end 382, such that a probe can be used to contact the RF detection point to complete the detection of the RF circuit. The printed antenna module 300 of the present invention further comprises a solder bump (not illustrated in diagram) The solder bump is soldered on the first connecting end 331 and the second connecting end 382 after the detection is completed, such that signals can be normally transmitted and the manufacturing is thus completed.

A comparison between the printed antenna module 300 of the present invention and the mono-pole antenna 100 of FIG. 1 (prior art) shows that the extension cord 180 and the totality or a portion of the extending part 13 are omitted, and the first connecting end 331 whose shape corresponds to that of the second connecting end 382 is directly integrated to the antenna body 31. That is, the first connecting end 331 is a portion of the first extending part 33 and therefore forms one end of the first extending part 33. Under the circumstances that the extension cord 180 is omitted, the disposition position of the adjacent second connecting end 382 is lifted upwards, such that the area on the substrate 30 at which the first connecting end 331 and the second connecting end 382 are disposed can be effectively used.

From another point of view, the first connecting end 331 of the present invention can be disposed on the area of the substrate 10 at which the antenna body 11 of FIG. 1 is disposed to replace the extension cord 180 and the totality or a portion of the extending part 13. Unlike the circuit breaker 18, the first connecting end 331 of the present invention will not occupy other area of the substrate 10.

In other words, in comparison to the mono-pole antenna 100 (prior art) of FIG. 1, the present invention effectively saves the plate material required for forming the area A1, such that the area of the ground terminal part 32 or the substrate 30 or even the overall size of the printed antenna module 300 can be largely reduced. In a practical example of manufacturing, the length of the mono-pole antenna 100 (prior art) is 27.39 mm, and the length of the printed antenna module 300 of the present invention is 25.10 mm. Although the two antennas do not differ widely in terms of width but the length is already reduced by 2 mm, which is 8% reduction in size, and relevant material cost can be reduced accordingly.

Based on the concepts disclosed in the first embodiment, the present invention has various implementations which can achieve similar effects with similar structural designs. For instance, in the first embodiment, the first connecting end 331 and the second connecting end 382 are L-shaped and corresponding to each other. The L-shape design occupies smaller space in the formation of circuit breaker, and the first connecting end 331 and the second connecting end 382 can be soldered with smaller solder bump in subsequent process. Under the same implementation purpose, the first connecting end 331 and the second connecting end 382 can have other shapes, such as semi-circles, triangles or rectangles, corresponding to each other. In another implementation, the first connecting end 331 and the second connecting end 382 are two adjacent metals not contacting each other.

The RF detection point can be disposed on the second surface of the substrate 30 corresponding to the second connecting end 382, and at the same time, a portion of the RF detection point can be concurrently distributed to the second surface of the substrate 30 corresponding to the feeding part 37 as disclosed in the prior art.

In the first embodiment, when the first connecting end 331 and the second connecting end 382 are soldered together after the detection is completed, the adjustment of impedance matching can be applied to the second connecting end 382 and the first extending part 33. Furthermore, the shape of the antenna of the printed antenna module 300 of the present invention is different from that of the antenna of the mono-pole antenna 100 (prior art), and the transmission efficiency of wireless signals for the two antennas will differ accordingly. For example, a certain degree of band offset will occur. In general, the present invention does not reduce the area or size of the extending part of the antenna body 31 used for radiating signals, such that the basic transmission efficiency can be achieved. However, desired transmission efficiency can be achieved by adjusting the shape of the antenna body. For example, additional bumps can be added to relevant extending parts.

Figure 4:
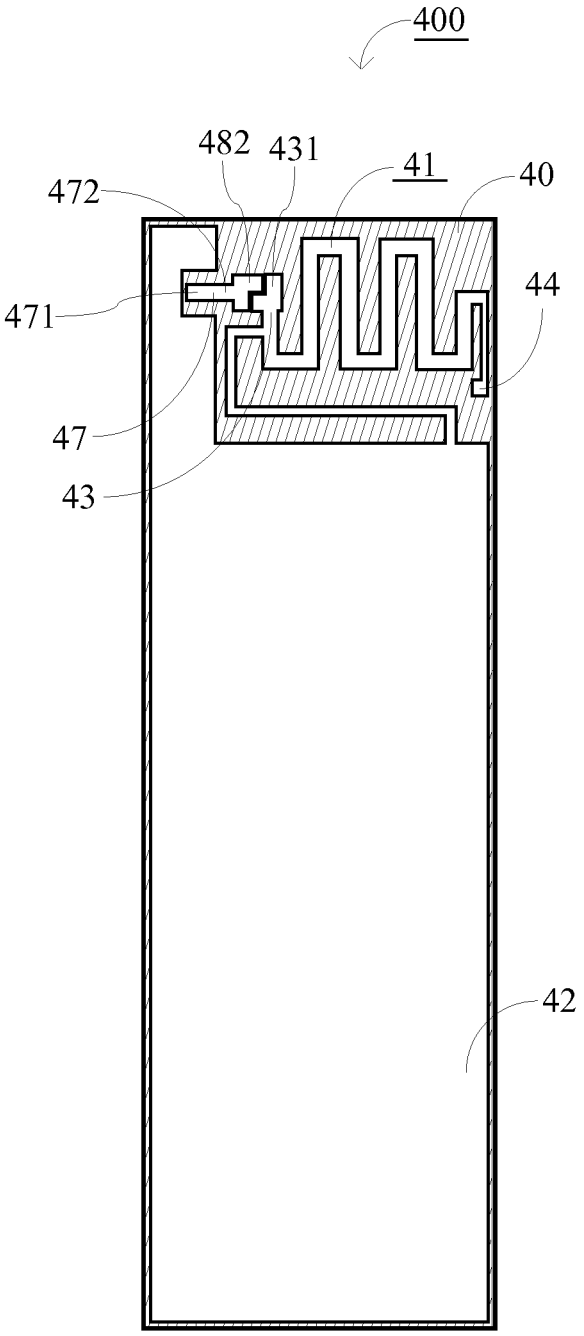
FIG. 4 is a schematic diagram of a printed antenna module 400 applied to an RF detection procedure according to an embodiment of the present invention.

The printed antenna module of the present invention can be realized by the mono-pole antenna of the first embodiment or other types of antennas. The implementation of the present invention is exemplified by a second embodiment disclosed below. Referring to FIG. 4, a schematic diagram of a printed antenna module 400 applied to an RF detection procedure according to an embodiment of the present invention is shown. In the second embodiment, the components common or similar to the mono-pole antenna 100 retain the same or similar numeric designations. The printed antenna module 400 comprises a substrate 40, an antenna body 41, a ground terminal part 42, relevant extending parts 43 and 44, a feeding part 47 (inclusive of the two ends 471 and 472), a first connecting end 431 and a second connecting end 482. As indicated in FIG. 4, the antenna body 41 of the present embodiment is exemplified by a planar inverse-F antenna (PIFA).

Figure 2:
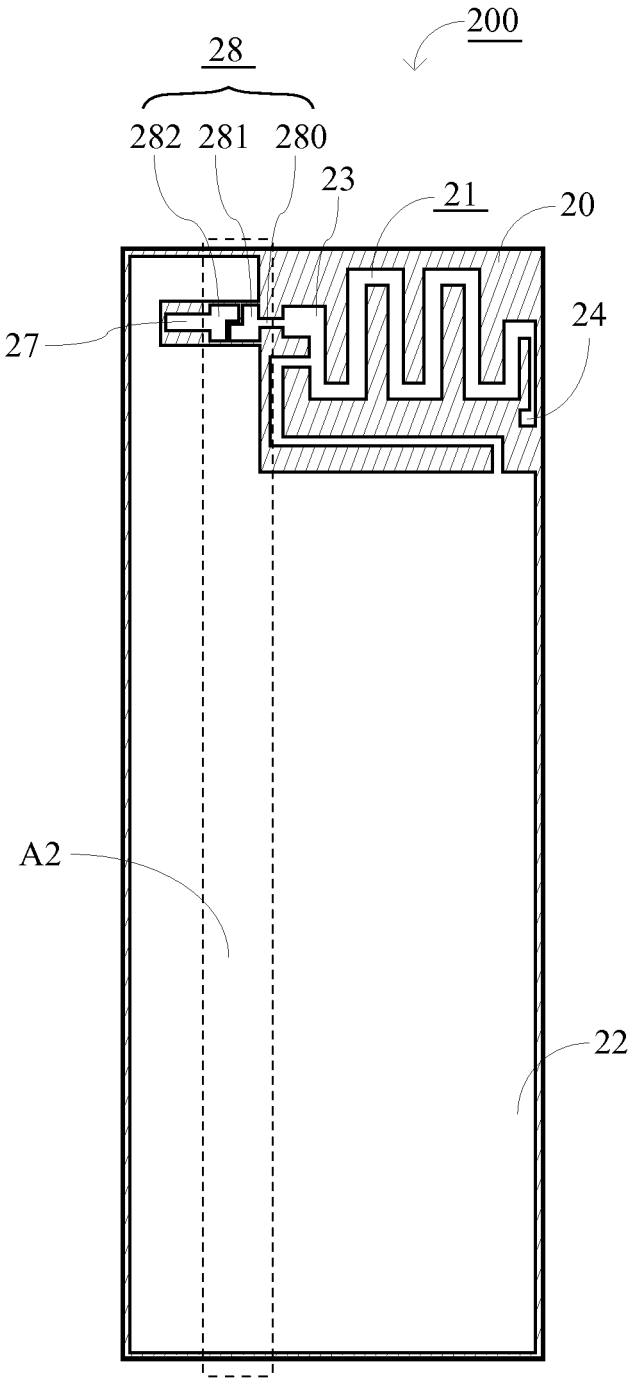
FIG. 2 (prior art)
FIG. 2 (prior art) is a structural diagram of a conventional planar inverse-F antenna (PIFA) 200 applied to RF detection.

The second embodiment and the first embodiment are different only in antenna type. Like the first embodiment, the second embodiment also omits the extension cord 280 and the totality or a portion of the extending part 23 of FIG. 2 (prior art), and directly integrates the first connecting end 431 to the antenna body 41 such that the first connecting end 431 forms one end of the first extending part 43. The second embodiment also can effectively use the area at which the first connecting end 431 and the second connecting end 482 are disposed. In comparison to the planar inverse-F antenna (PIFA) 200 of FIG. 2 (prior art), the present invention saves the plate material required for forming the area A2. In a practical example of manufacturing, the width of the planar inverse-F antenna (PIFA) 200 (prior art) is 16.21 mm, and the width of the printed antenna module 400 of the present invention is 13.58 mm. Although the two antennas do not differ widely in terms of length but the width is already reduced by 3 mm, which is 16% reduction in size, and relevant material cost can be reduced accordingly.

To summarize, in response to the trend that the small-sized or portable electronic device is directed towards light-weight, slimness and compactness, how to downsize the components or structures, such as antenna structure, circuit board or wireless signal transmission module, disposed inside the device has become a prominent task for the industries. Based on the RF detection procedure applied to the antenna according to the currently available technologies, the design of a circuit breaker or two adjacent connecting ends whose shapes are corresponding to each other is essential. The present invention provides a printed antenna module whose antenna structure maintains corresponding design in response to the operation of the RF detection procedure. The printed antenna module of the present invention effectively downsizes the printed antenna module and has successfully achieved industry standards. On the other hand, the reduction in the size of the substrate or circuit board not only downsizes the small-sized or portable electronic device but also reduces the use of materials and saves a considerable amount of cost in large-scale production. Therefore, the present invention effectively resolves the problems disclosed in the prior art and successfully achieves the purpose of the disclosure.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A printed antenna module applied to a radio frequency (RF) detection procedure, wherein the printed antenna module consists essentially of:

a substrate comprising a first surface and a second surface disposed oppositely;

a ground terminal part disposed on the first surface of the substrate;

a feeding part disposed on the first surface of the substrate, wherein a first end of the feeding part is disposed adjacent to the ground terminal part;

an antenna body disposed on the first surface of the substrate relative to the ground terminal part, wherein the antenna body consists essentially of a first extending part and a second extending part, and the second extending part radiating transmission signals; and a second connecting end disposed on the first surface of the substrate adjacent to a first end of the first extending part, wherein the first end of the first extending part and the second connecting end correspond to each other in shape, a second end of the feeding part is connected to the second connecting end, an RF detection point is formed on the second surface of the substrate corresponding to the second connecting end, and the first end of the first extending part and the second connecting end forms an open circuit;

wherein the shape of the first end of the first extending part corresponds to the shape of the second connecting end, the shape of the second end of the feeding part corresponds to the shape of the ground terminal part, and the first end of the first extending part, the second connecting end and the second end of the feeding part are L-shaped, semi-circular, triangular or rectangular.

2. The printed antenna module according to claim 1, wherein the substrate relates to a printed circuit board formed by a dielectric material.

3. The printed antenna module according to claim 1, wherein the ground terminal part relates to a printed metal surface.

4. The printed antenna module according to claim 1, wherein the first end of the feeding part can be directly connected to an RF circuit or via a feeder line.

5. The printed antenna module according to claim 1, wherein the first extending part is for adjusting impedance matching.

6. The printed antenna module according to claim 1, wherein the printed antenna module comprises a solder bump soldered on the first end and the second connecting end.

7. The printed antenna module according to claim 6, wherein the second connecting end is for adjusting impedance matching.

8. The printed antenna module according to claim 1, wherein the substrate comprises a through hole via which the RF detection point is electrically connected to the second connecting end, and the RF detection procedure relates to using a probe to contact the RF detection point.

9. The printed antenna module according to claim 1, wherein the RF detection point is concurrently distributed to the second surface of the substrate corresponding to the feeding part.

* * * * *